US008870253B2

(12) United States Patent
Mongan et al.

(10) Patent No.: US 8,870,253 B2
(45) Date of Patent: Oct. 28, 2014

(54) LOCKOUT SWITCH APPARATUS AND METHOD

(71) Applicants: Dan Eugene Mongan, Oregon, IL (US); Skyler D. Halcom, Loves Park, IL (US)

(72) Inventors: Dan Eugene Mongan, Oregon, IL (US); Skyler D. Halcom, Loves Park, IL (US)

(73) Assignee: The Caldwell Group, Inc., Rockford, IL (US)

( * ) Notice: Subject to any disclaimer, the term of this patent is extended or adjusted under 35 U.S.C. 154(b) by 0 days.

(21) Appl. No.: 13/726,727

(22) Filed: Dec. 26, 2012

(65) Prior Publication Data

US 2013/0168985 A1 Jul. 4, 2013

Related U.S. Application Data

(60) Provisional application No. 61/580,958, filed on Dec. 28, 2011.

(51) Int. Cl.

| | |
|---|---|
| ***B66C 1/10*** | (2006.01) |
| ***B66C 1/42*** | (2006.01) |
| ***B66C 15/00*** | (2006.01) |
| ***H01H 3/02*** | (2006.01) |
| ***B66C 1/44*** | (2006.01) |
| *H01H 3/16* | (2006.01) |

(52) U.S. Cl.

CPC ..... *B66C 15/00* (2013.01); *H01H 3/022* (2013.01); *H01H 3/16* (2013.01); *B66C 1/42* (2013.01); *B66C 1/445* (2013.01); *Y10S 294/907* (2013.01)

USPC ..... 294/67.1; 294/67.33; 294/907; 414/626

(58) Field of Classification Search

USPC ..... 294/67.1, 67.33, 67.5, 68.3, 81.1, 294/81.54, 81.6, 81.61, 81.62, 82.15, 82.3, 294/82.34, 907; 414/626

See application file for complete search history.

(56) References Cited

U.S. PATENT DOCUMENTS

| | | | | |
|---|---|---|---|---|
| 2,718,320 | A * | 9/1955 | Nelson et al. | 414/626 |
| 2,718,321 | A * | 9/1955 | Westermeyer | 414/626 |
| 2,904,369 | A * | 9/1959 | Campbell | 294/82.3 |
| 3,177,028 | A * | 4/1965 | Cozzoli et al. | 294/82.3 |
| 3,845,978 | A * | 11/1974 | Huber | 294/82.33 |
| 4,396,218 | A * | 8/1983 | Stevens | 294/81.41 |
| 5,178,427 | A * | 1/1993 | Jorritsma | 294/82.36 |
| 5,791,861 | A * | 8/1998 | Seelig | 414/627 |

* cited by examiner

*Primary Examiner* — Dean Kramer

(74) *Attorney, Agent, or Firm* — Reinhart Boerner Van Deuren P.C.

(57) ABSTRACT

An improved apparatus and/or method for safely lifting a load along a lift axis are provided, through utilization of an automatic lockout arrangement operatively connected between the point of application of a lifting force and a motorized clamping arrangement for grasping the load. The automatic lockout arrangement precludes electrical power from being applied to open the system when the lifting force being applied to the automatic lockout arrangement has reached a predetermined lockout value.

22 Claims, 9 Drawing Sheets

LOCKOUT SWITCH APPARATUS AND METHOD

FIELD OF THE INVENTION

This patent application claims the benefit of U.S. Provisional Patent Application No. 61/580,958, filed Dec. 28, 2011, the entire teachings and disclosure of which are incorporated herein by reference thereto.

BACKGROUND OF THE INVENTION

During material handling processes, it is sometimes necessary to employ an apparatus having a clamping arrangement to grasp a load that is to be lifted by an overhead crane. For example, where the load to be lifted is a slab of material, or perhaps a stack of sheets of material, it may be necessary to use a clamping arrangement having fingers or flanges which extend under the load, to grasp or clamp the load in such a manner that it can be safely lifted with a crane.

In some instances, such a clamping arrangement may include moveable clamping arms or legs driven by a motor. Such a motor may be electric, pneumatic or hydraulic.

It is desirable when a motor-driven clamping arrangement is utilized to provide some form of lockout protection for operation of the motor while the load is being lifted. It is desirable that such a lockout arrangement preclude having the clamping arrangement release the load while lifting force is being applied.

BRIEF SUMMARY OF THE INVENTION

The invention provides an improved apparatus and/or method for safely lifting a load along a lift axis through utilization of an automatic lockout arrangement connected between the point of application of a lifting force and a motorized clamping arrangement for grasping the load.

One form of the invention includes an electrically operable clamping arrangement, and an electrical lockout arrangement. The electrically operable clamping arrangement has clamping elements moveable between an open and a closed position of the clamping arrangement for selectively grasping and releasing the load. The electrical lockout arrangement is connected at a lower end thereof to the clamping arrangement and has an upper end thereof adapted for application of a lifting force along the lifting axis.

The electrically operable clamping arrangement and the electrical lockout arrangement are cooperatively configured such that the electrical lockout arrangement precludes electrical power from being applied to open the clamping arrangement when the lifting force being applied to the upper end of the electrical lockout arrangement has reached a predetermined lockout value while the clamping arrangement is grasping the load. The electrically operable clamping arrangement and the electrical lockout arrangement are also cooperatively configured such that the electrical lockout arrangement allows electrical power to be applied to the clamping arrangement for opening the clamping arrangement when the lifting force being applied to the upper end of the electrical lockout arrangement is below the predetermined lockout value.

In various forms of the invention, the clamping arrangement and lockout arrangement may be of any appropriate type, including configurations being mechanically, pneumatically or hydraulically driven, or various combinations of electrically, mechanically, pneumatically or hydraulically driven arrangements.

In some forms of the invention, the predetermined lockout value of the lifting force is adjustable.

In some forms of an apparatus/method according to the invention, the lockout arrangement may include an upper member adapted for connection to the lifting force, a lower member adapted for connection to the clamping arrangement, a spring arrangement disposed between the upper and lower members for urging the upper and lower members toward a non-lockout position of the lockout arrangement, and a switch arrangement operatively connected between the upper and lower members for detecting relative movement of the upper and lower members between the non-lockout position of the lockout arrangement and a lockout position of the lockout arrangement. The switch may take any appropriate form, including: electrical, pneumatic and hydraulic, or a mechanical switching arrangement.

In some forms of the invention, the switch arrangement is configured and operatively connected to an electrically operated clamping arrangement in such a manner that the switch arrangement conducts electrical current when the upper and lower members are disposed with respect to one another in the non-lockout position. The switch may be further configured and operatively connected in such a manner that the switch arrangement does not conduct electrical current when the upper and lower members are disposed with respect to one another in the lockout position. In some forms of the invention, the lockout switch arrangement directly cuts off, or reconnects, electric power to a motor driving the clamping arrangement. In other embodiments of the invention, the switch may be connected to a controller and supply only a control signal to the controller, with the controller then being operatively connected to the motor driving the clamping arrangement for controlling the application of electrical power to the motor.

In some forms of the invention, the spring arrangement defines upper and lower ends thereof. The upper member includes an opening extending generally perpendicularly to the lifting axis through the lifting member with the opening having an upward-facing surface thereof engaging the lower end of the spring arrangement. The lower member includes a downward-facing surface thereof engaging the upper end of the spring arrangement.

The upper member may extend entirely around the opening, and the lower member may form an inverted U-shape having two legs extending downward from a shelf element connecting the proximal ends of the two legs. At least one distal end of at least one of the legs may be configured for attachment to the clamping arrangement. The shelf of the U-shaped lower member may have a lower surface thereof forming the downward-facing surface of the lower member.

In some forms of the invention, the upper and lower members of the lockout arrangement are cooperatively configured for contacting one another to limit travel of the lower member with respect to the upper member when a load is applied to the lifting arrangement along the lifting axis. The upper member may define an upward-facing travel limit surface thereof disposed to contact a corresponding downward-facing travel limit surface of the lower member. The travel limit surface of the lower member may include a portion of a downward-facing surface on the shelf of the lower member.

The spring arrangement in a lockout arrangement, according to the invention, may include at least one compression spring element defining a central bore thereof extending substantially parallel to the lifting axis. The upper and lower members may each have stop elements thereof extending into lower and upper ends respectfully of the central bore in the spring element. Juxtaposed surfaces of the stop elements within the central bore of the compression spring element may be cooperatively configured for engaging one another to limit travel of the lower member with respect to the upper member when a load is applied to the lifting arrangement along the lifting axis. The compression spring arrangement may include two or more spring elements disposed in a parallel force arrangement, with at least one of the springs being removable and/or replaceable to adjust the force required to move the upper and lower members with respect to one another during an application of the lifting force.

The invention may take the form of a lifting apparatus/method, according to the invention, having a lockout arrangement according to any claim herein, and a clamping arrangement having clamping elements moveable between an open and a closed position of the clamping arrangement for selectively grasping and releasing the load. In some forms of the invention, the lockout arrangement is electrical, and the clamping arrangement is electrically operable.

A lifting apparatus/method, according to the invention, may also include a controller operatively connected between the lockout arrangement and the clamping arrangement, for selectively controlling the clamping arrangement in accordance with inputs received from the lockout arrangement.

Other aspects, objects and advantages of the invention will be apparent from the following detailed description and accompanying drawings of exemplary embodiments of the invention.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

Figure 1:
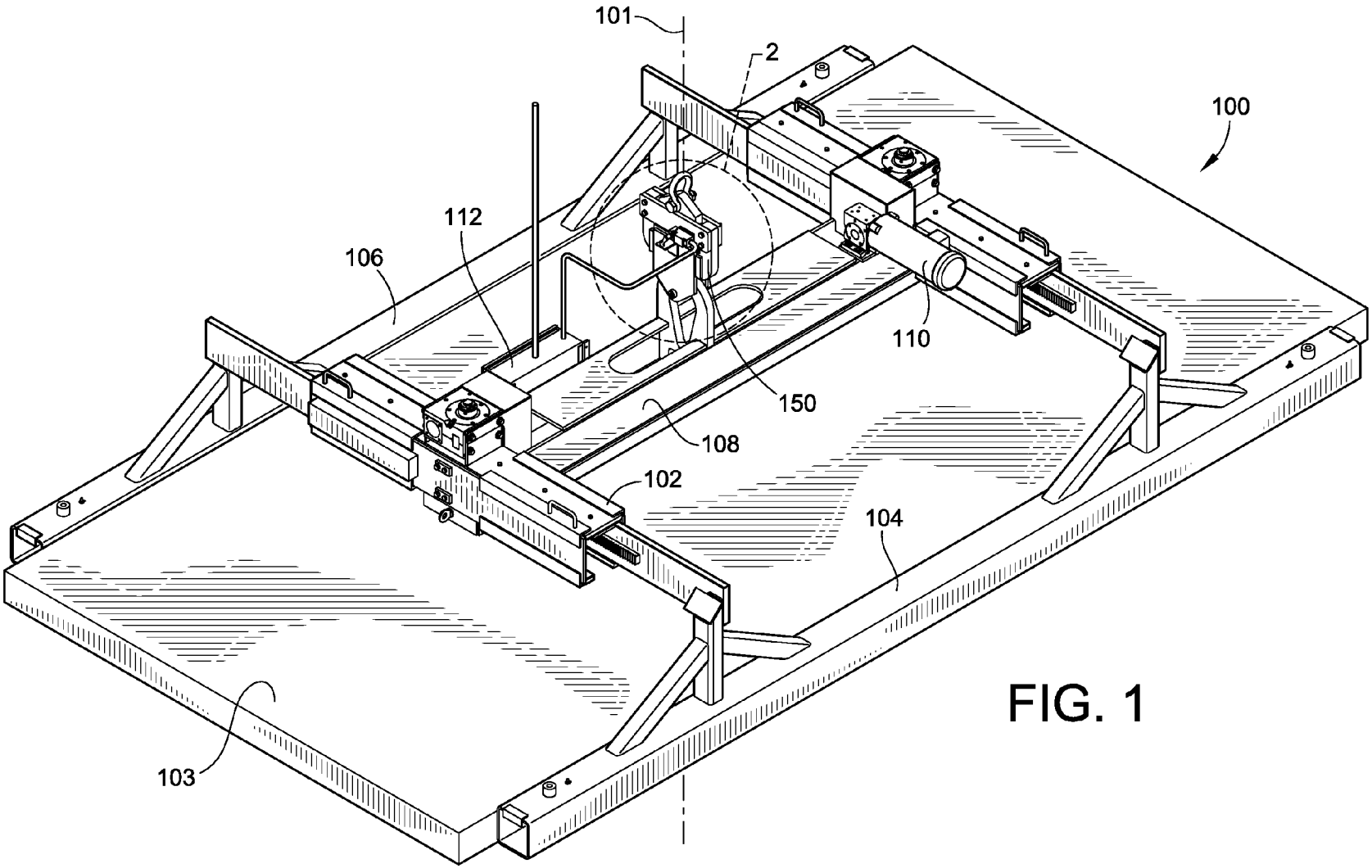
FIG. 1 is a perspective illustration of a lifting apparatus, according to the invention.

FIG. 1 shows an exemplary embodiment of an electrically operable and electrically driven lifting apparatus 100, according to the invention for application of a lifting load along a lifting axis 101. The lifting apparatus 100 includes an electrically operable clamping arrangement 102, and an electrical lockout arrangement 150.

Figure 2:
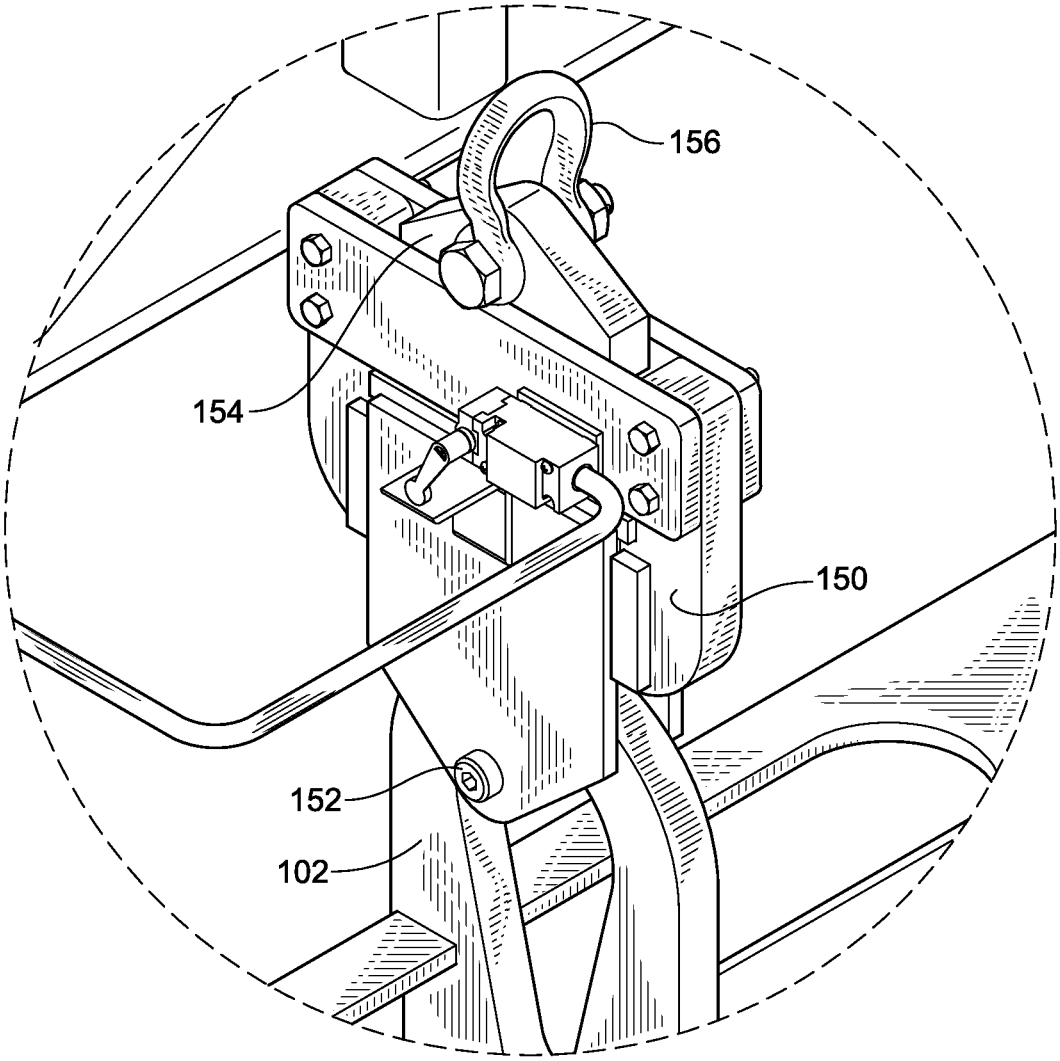
FIG. 2 is a perspective illustration of an enlarged portion of FIG. 1, taken along the circular line "2"

As shown in FIG. 2, the electrical lockout arrangement 150 is connected at a lower end 152 to the clamping arrangement 102. The electrical lockout arrangement 150 is connected at an upper end 154 thereof to a lifting clevis 156 for application of a lifting load along the lifting axis 101.

As will be described in more detail below, the electrically operable clamping arrangement 102 and the electrical lockout arrangement 150 are cooperatively configured such that the electrical lockout arrangement 150 precludes electrical power from being applied to open the clamping arrangement 102 when a lifting force being applied to the upper end 154 of the electrical lockout arrangement 150 has reached a predetermined lockout value while the clamping arrangement 102 is grasping the load 103. The clamping arrangement 102 and the lockout arrangement 150 are also cooperatively configured such that the electrical lockout arrangement 150 allows electrical power to be applied to the clamping arrangement 102 for opening the clamping arrangement 102 when the lifting force being applied to the upper end 154 of the electrical lockout arrangement 150 is below the predetermined lockout value.

As shown in FIG. 1, the clamping arrangement 102 and the exemplary embodiment of the lifting apparatus 100 includes first and second moveable clamping arms 104, 106 which are operatively connected through a rack-and-pinion drive system to a central frame 108, including a drive mechanism operatively connected to an electric motor 110. The electric motor 110 may be operated in one direction to move the clamping arms 104, 106 outwardly to release the load 103, or conversely be driven in an opposite direction to move the clamping arms 104, 106 inward to grasp the load 103. The lifting apparatus 100 also includes an electrical controller 112 mounted on the central frame 108 of the clamping arrangement 102.

Figure 3:
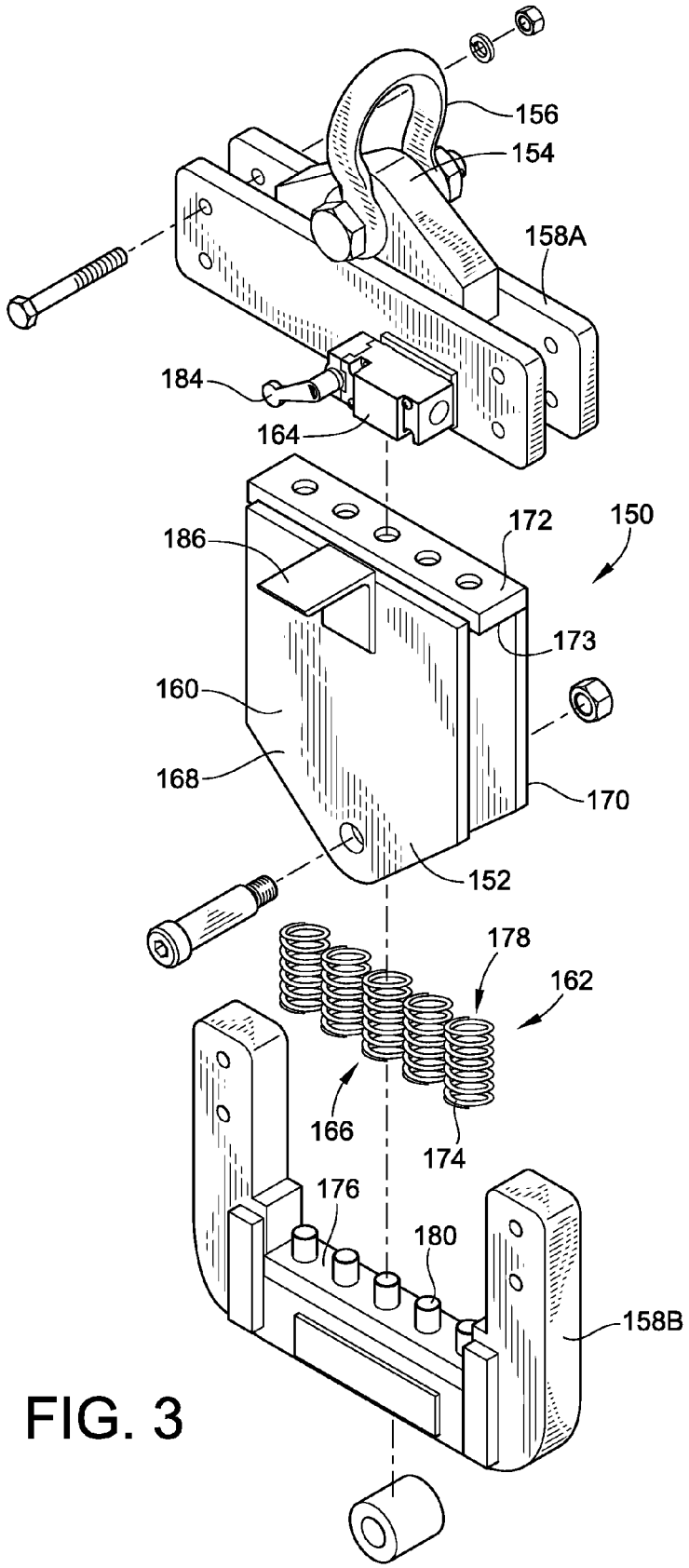
FIG. 3 is an exploded perspective illustration of a lockout arrangement of the apparatus of FIG. 1.
Figure 4:
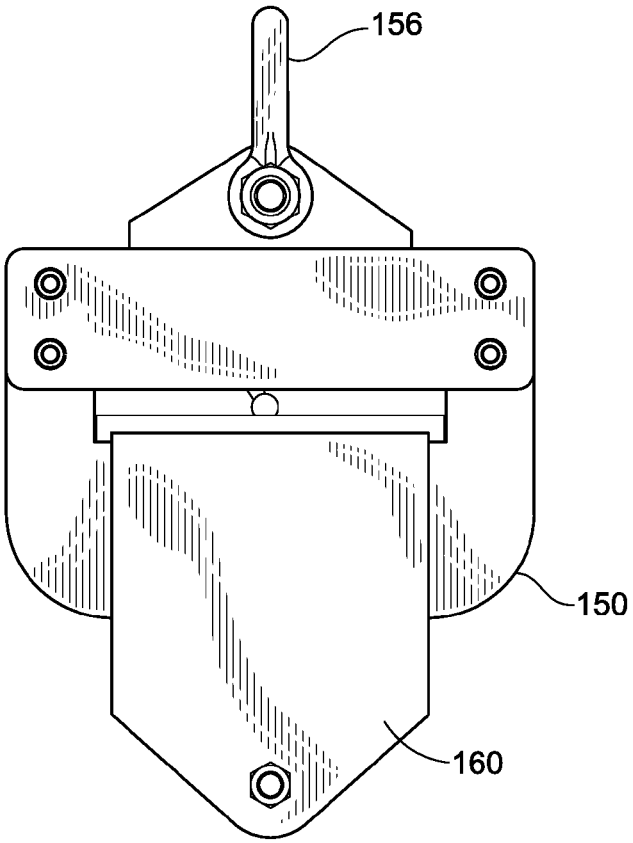
FIGS. 4 and 6-9 are orthographic illustrations of the exemplary embodiment of the lockout arrangement shown in FIGS. 4 and 5, with FIGS. 4-9 illustrating various structural and functional elements and aspects of the lockout arrangement.
Figure 5:
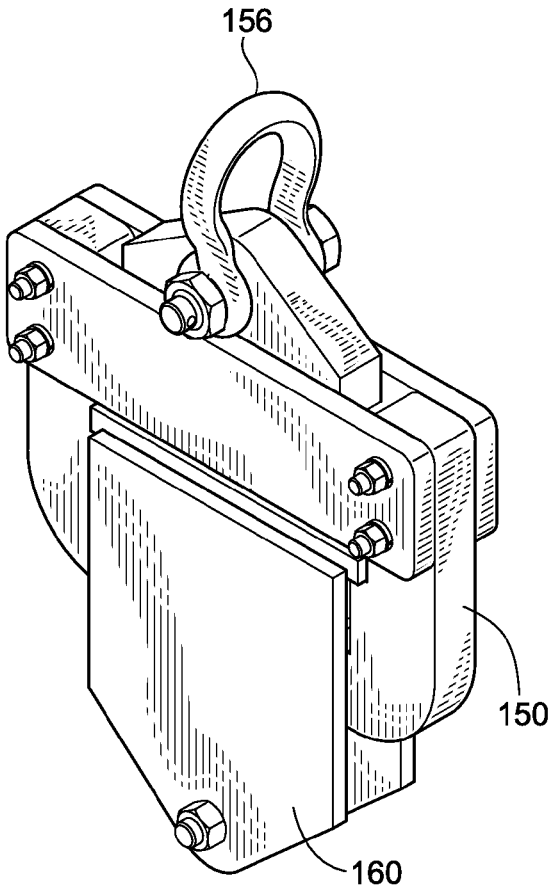
FIG. 5 is an assembled perspective illustration of the exemplary embodiment of the lockout apparatus shown in FIG. 4.

FIG. 3 shows an exploded view of the electrical lockout arrangement 150 of the exemplary embodiment of the lifting apparatus 100. The lockout apparatus 150 includes an upper member 158 (also referred to as a first member herein) formed by a top bail assembly 158A and a bottom spring support 158B, a lower member 160 (also referred to as a second member herein), a spring arrangement 162 and a limit switch arrangement 164.

As will be understood from an examination of FIGS. 3-9, in the exemplary embodiment of the lifting apparatus 100, the upper member 158 extends entirely around an opening 166 extending through the upper member 158 in a direction generally perpendicularly to the lifting axis 101. The lower member 160 has a generally U-shaped form including first and second legs 168, 170 extending downward from a shelf element 172, with the upper ends of the first and second legs 168, 170 being fixedly attached to the shelf element 172. The lower ends of both the first and second legs 168, 170 are configured to form an attachment to the clamping arrangement 102.

The spring arrangement 162 in the exemplary embodiment of the apparatus 100 includes a plurality of compression springs 174 (only one of which is labeled in FIG. 3). The top ends of the compression springs 174 bear against a lower surface of the shelf element 172, and the lower ends of the compression springs 174 bear against an upward-facing surface 176 of the upper member 158. The compression springs 174 also define a central bore 178 into which guide pins 180, 182 extend from the upper and lower members 158, 160 respectively.

Figure 6:
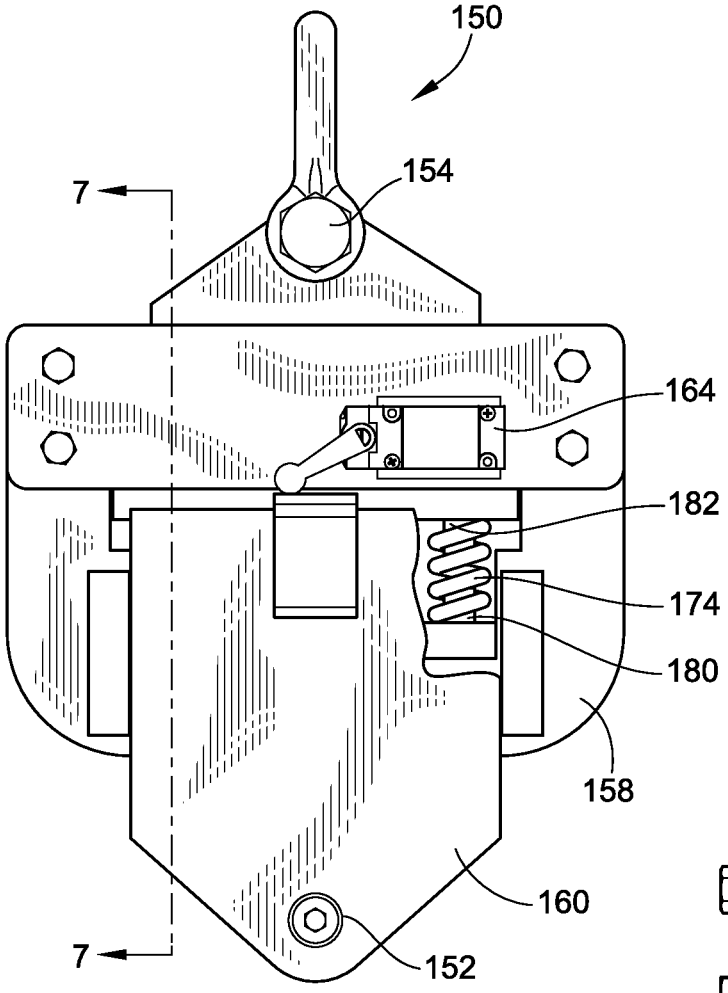
Figure 7:
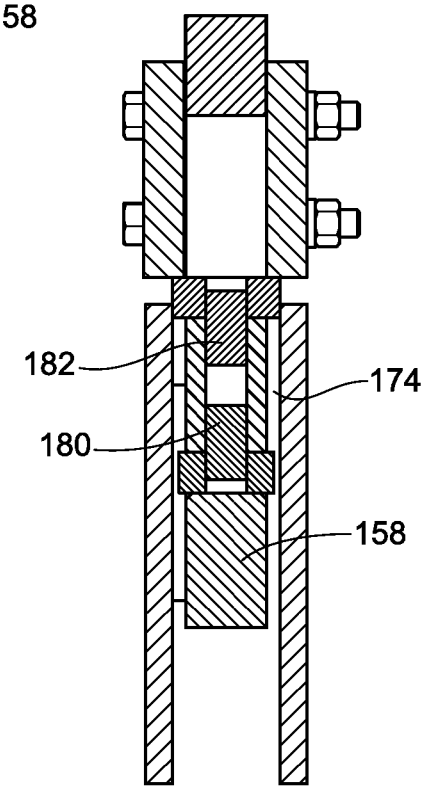
Figure 8:
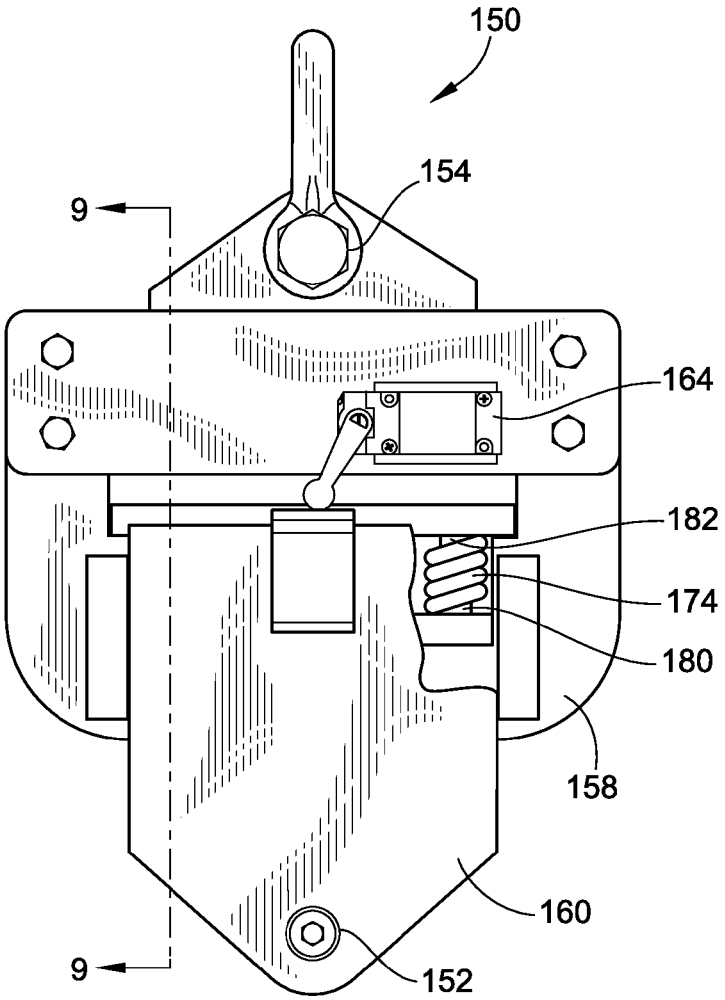
Figure 9:
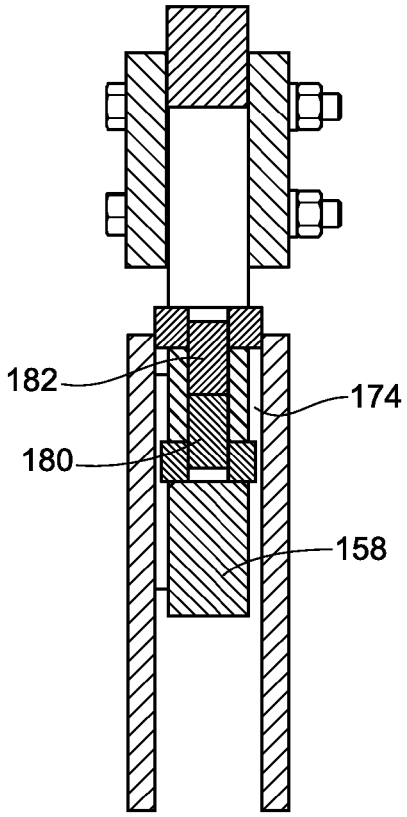

As will be understood from an examination of annotated FIGS. 6-9, when the lockout arrangement 150 is not exposed to a lifting load applied across the upper and lower ends 154, 152 of the lockout arrangement 150, the springs 174 of the spring arrangement 162 urge the upper and lower members 158, 160 toward an un-locked position as shown in FIGS. 6 and 7. Conversely, when a sufficient lifting load is applied across the lockout arrangement 150, the springs 174 of the spring arrangement 162 are compressed as the upper and lower elements 158, 160 move to the lockout position shown in FIGS. 8 and 9.

As will be understood from an examination of FIGS. 3-9, the limit switch 164 is mounted to the upper member 158, in the exemplary embodiment of the apparatus 100, and includes a limit switch arm 184 which pivotably contacts a limit switch bracket 186 attached to the lower member 160. Relative movement of the upper and lower members 158, 160 with respect to one another as load is applied across the lockout arrangement 150 causes the limit switch arm 184 to move and close, or open, the limit switch 164.

Figure 10:
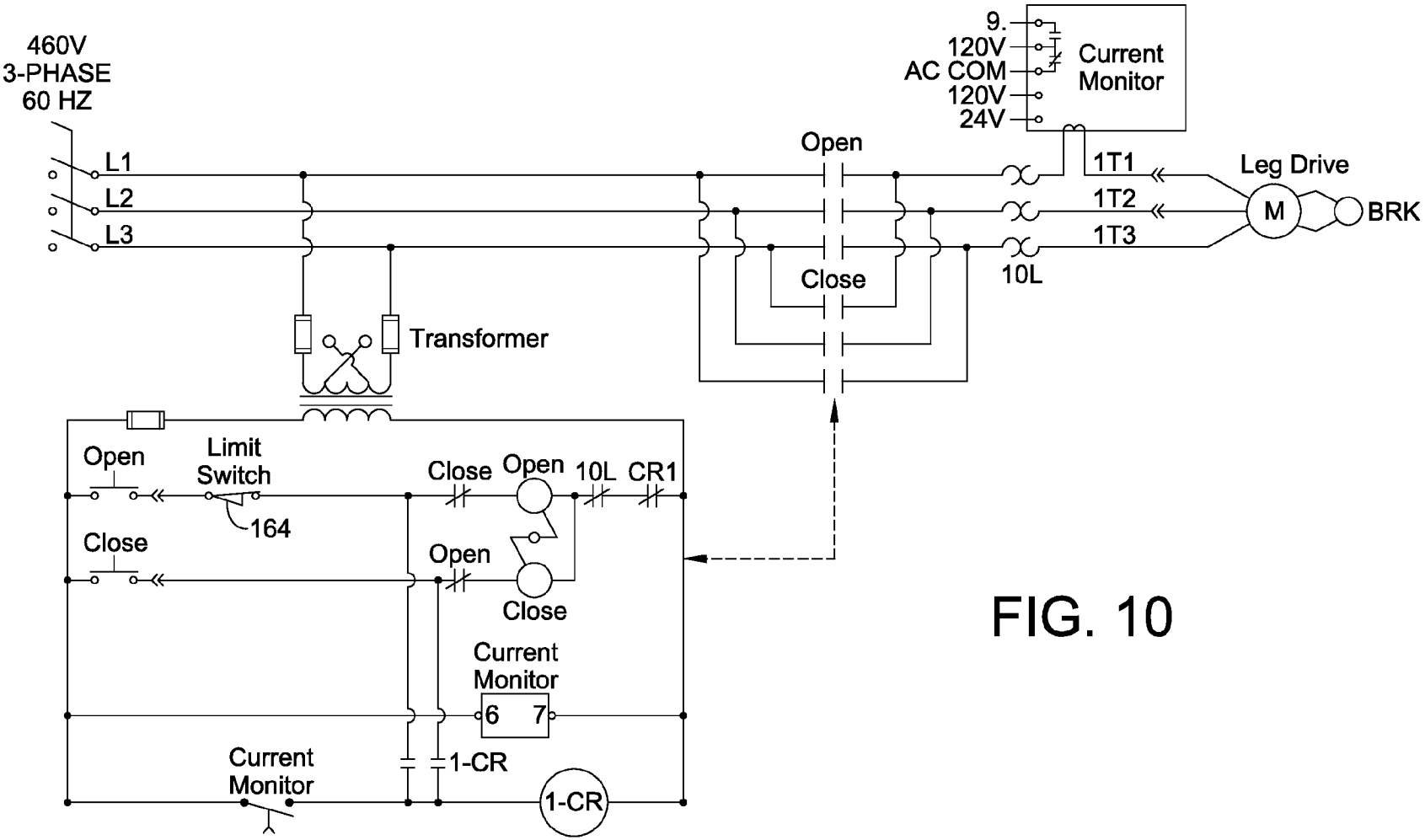
FIG. 10 is a schematic illustration of one possible control arrangement for connecting a limit switch of the lockout arrangement in a manner for controlling operation of a drive motor in a clamping arrangement according to the invention.

As shown in FIG. 10, the limit switch 164 of the exemplary embodiment 100 is operatively connected to the controller 112 in such a manner that operation of the limit switch 164 causes the controller to preclude movement of the clamping arrangement 102 toward an unclamped position thereof, whenever a preselected lifting load is applied across the lockout arrangement 150.

As will be understood from an examination of FIGS. 3-9, the upper and lower members 158, 160 and the locating pins 180, 182, of the lockout arrangement 150, are configured and to have juxtaposed surfaces which contact each other when the upper and lower members 158, 160 have moved a predetermined maximum travel distance with respect to one another as the lifting force is applied. The spring arrangement 162 in the exemplary embodiment 100 is also configured so that the force required to move the upper and lower members 158, 160 the maximum travel distance with respect to one another can be adjusted for loads of different weights. This adjustment can be accomplished by removing some of the multiple compression springs 174, or interchanging one or more of the compression springs 174 with compression springs having a different spring rate.

Figure 11:
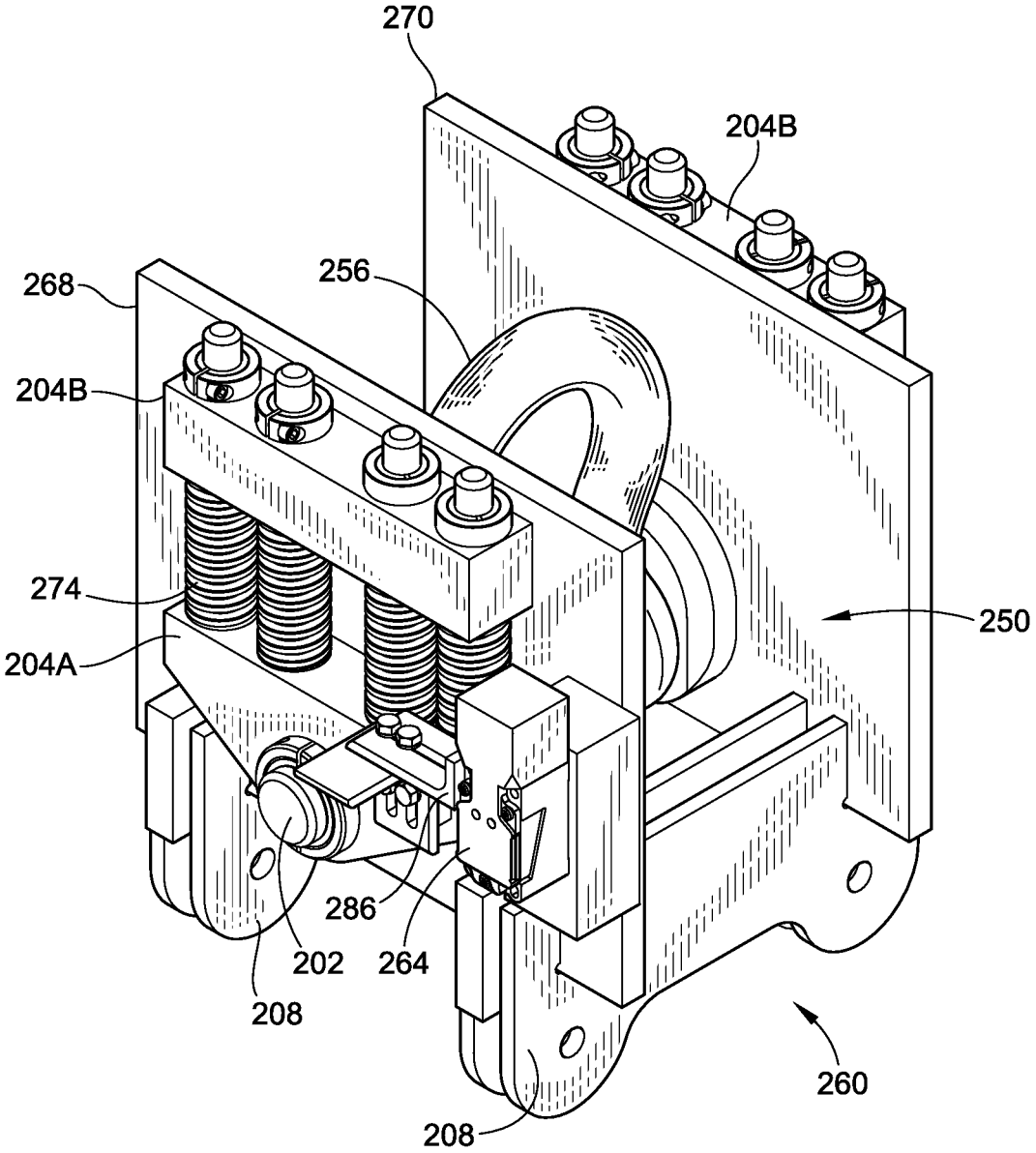
FIG. 11 is perspective view of an exemplary alternate embodiment of a lockout apparatus.
Figure 12:
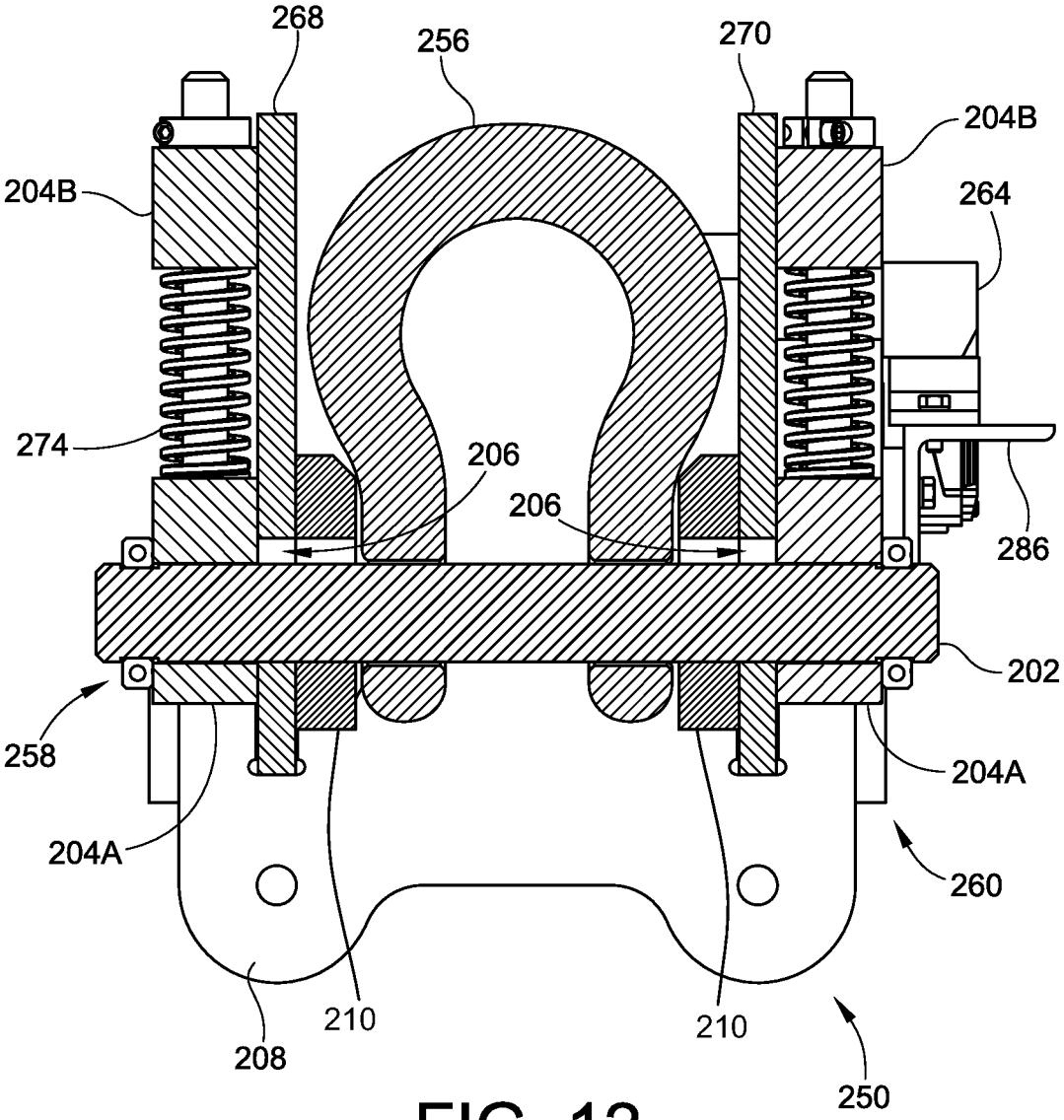
FIG. 12 is a side cross sectional view of the embodiment of FIG. 11.

Turning now to FIGS. 11 and 12, an alternate embodiment of a lockout arrangement 250 is illustrated. This embodiment provides the same functionality and advantages as the lockout arrangement 150 described above, with some structural distinctions which will be discussed below. This embodiment is equally usable with the clamping arrangement 102 illustrated above, or other similar or dissimilar clamping arrangements.

With particular reference to FIG. 11, the lockout arrangement 250 includes a first member 258, and a second member 260. At least one spring 274 is positioned between the first and second members 258, 260. As illustrated, a plurality of springs 274 are utilized. The springs 274 function in the same manner as described above relative to FIGS. 1-10 in that they bias the first and second members 258, 260 to a non-lockout position. However, as a load is applied to a clevis 256 which is connected to the first member 258, the first member 258 will move upwardly against the resistance of the springs 274 and towards a lockout position in the same manner as described above.

A sensor 264 in the form of an edge detector is positioned on the second member 260. The sensor 264 detects the location of an edge of a tab 286 fixedly connected to the first member 258. As the first member 258 moves, so too does the tab 286, and the sensor 264 detects this motion. Those skilled in the art will recognize that other types of sensors may be utilized to detect the relative movement between the first and second members 258, 260, e.g. proximity, light, hall effect, etc.

Turning now to FIG. 12, the first member 258 includes a pin 202 which extends through the second member 260, as well as opposed spring retaining blocks 204A of the first member 258. A pair of opposed spring retaining blocks 204B are also mounted on the second member 260, such that the ends of springs 274 are held respectively by the spring retaining blocks 204A, 204B.

The second member 260 also includes a pair of opposed sidewalls 268, 270. Each of the sidewalls 268, 270 includes a slotted opening 206 through which the pin 202 of the first member extends through. A pair of transverse members 208 extend between the sidewalls 268, 270 of the second member 260, and maintain the spacing thereof. Additionally, a pair of opposed spacer elements 210 that also include slotted openings are mounted to interior sides of the sidewalls 268, 270 to maintain the centered position of clevis 256.

As will be understood from inspection of FIG. 12, as the first member 258, and more specifically the pin 202 thereof, moves upwardly within slots 206, springs 274 will compress. The sensor 264 will detect this motion by detecting the movement of the tab 286 connected to the first member 258. As will also be understood from inspection of FIG. 12, the slots 206 in the second member 260 define the maximum limit of upward travel of the first member 258 relative to the second member 260. Once a predetermined amount of travel of the first member 258 relative to the second member 260, the lock-out functionality described relative to the schematic at FIG. 10 will ensue.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lifting apparatus for lifting load along a lift axis, the apparatus comprising:

an electrically operable clamping arrangement having clamping elements movable between an open and a closed position of the clamping arrangement for selectively grasping and releasing the load;

an electrical lockout arrangement connected at a lower end thereof to the clamping arrangement and having an upper end thereof adapted for application of a lifting force along the lifting axis;

the electrically operable clamping arrangement and the electrical lockout arrangement being cooperatively configured such that the electrical lockout arrangement precludes electrical power from being applied to open the clamping arrangement when the lifting force being applied to the upper end of the electrical lockout arrangement has reached a predetermined lockout value while the clamping arrangement is grasping the load;

the electrically operable clamping arrangement and the electrical lockout arrangement also being cooperatively configured such that the electrical lockout arrangement allows electrical power to be applied to the clamping arrangement for opening the clamping arrangement when the lifting force being applied to the upper end of the electrical lockout arrangement is below the predetermined lockout value;

wherein, the predetermined lockout value of the lifting force is adjustable;

wherein the predetermined lockout value is a function of a spring constant of at least one spring of the electrical lockout arrangement; and wherein the at least one spring includes multiple springs arranged in a parallel arrangement relative to the spring force applied thereby.

2. The lifting apparatus of claim 1, wherein, the electrical lockout arrangement comprises, an upper member adapted for connection to the lifting force, a lower member adapted for connection to the clamping arrangement, a spring arrangement comprising the multiple springs arranged in a parallel arrangement disposed between the upper and lower members for urging the upper and lower members toward a non-lockout position of the lockout arrangement, and a motion detection arrangement operatively connected between the upper and lower members for detecting relative movement of the upper and lower members between the non-lockout position of the electrical lockout arrangement and a lockout position of the lockout arrangement.

3. The lifting apparatus of claim 2, wherein, the motion detection arrangement is configured and operatively connected to the electrically operated clamping arrangement in such a manner that the motion detection arrangement conducts electrical current when the upper and lower members are disposed with respect to one another in the non-lockout position, and further configured and operatively connected in such a manner that the motion detection arrangement does not conduct electrical current when the upper and lower members are disposed with respect to one another in the lockout position.

4. The lifting apparatus of claim 2, wherein, the lockout arrangement further comprises mechanical stops to limit relative movement between the upper and lower members.

5. The lifting apparatus of claim 2, wherein the motion detection arrangement includes a switch body mounted to the upper member with a switch arm extending from the switch body.

6. The lifting apparatus of claim 5, wherein the switch arm includes a distal end in contact with the lower member, the switch arm configured to move based upon movement of the lower member relative to the upper member.

7. The lifting apparatus of claim 2, wherein the motion detection arrangement includes an edge detector mounted to the lower member for detecting the presence of a portion of the upper member in proximity to the edge detector based upon movement of the upper member relative to the lower member.

8. The lifting apparatus according to claim 1, further comprising, a controller operatively connected between the electrical lockout arrangement and the clamping arrangement, the controller configured to terminate the supply of electrical power to the clamping arrangement based upon an input signal received from the electrical lockout arrangement.

9. A lifting apparatus for lifting a load along a lift axis, the apparatus comprising:

an electrically operable clamping arrangement having clamping elements movable between an open and a closed position of the clamping arrangement for selectively grasping and releasing the load;

an electrical lockout arrangement connected at a lower end thereof to the clamping arrangement and having an upper end thereof adapted for application of a lifting force along the lifting axis;

the electrically operable clamping arrangement and the electrical lockout arrangement being cooperatively configured such that the electrical lockout arrangement precludes electrical power from being applied to open the clamping arrangement when the lifting force being applied to the upper end of the electrical lockout arrangement has reached a predetermined lockout value while the clamping arrangement is grasping the load;

the electrically operable clamping arrangement and the electrical lockout arrangement also being cooperatively configured such that the electrical lockout arrangement allows electrical power to be applied to the clamping arrangement for opening the clamping arrangement when the lifting force being applied to the upper end of the electrical lockout arrangement below the predetermined lockout value;

wherein, the electrical lockout arrangement comprises, an upper member adapted for connection to the lifting force, a lower member adapted for connection to the clamping arrangement, a spring arrangement disposed between the upper and lower members for urging the upper and lower members toward a non-lockout position of the lockout arrangement, and a switch arrangement operatively connected between the upper and lower members for detecting relative movement of the upper and lower members between the non-lockout position of the electrical lockout arrangement and a lockout position of the lockout arrangement;

wherein:

the spring arrangement defines upper and lower ends thereof;

the upper member includes an opening extending generally perpendicular to the lifting axis through the upper member, with the opening having an upward-facing surface thereof engaging the lower end of the spring arrangement; and the lower member includes a downward facing surface thereof engaging the upper end of the spring arrangement.

10. The lifting apparatus of claim 9, wherein:

the upper member extends entirely around the opening and the lower member substantially forms an inverted U-shape having two legs extending downward from a shelf element connecting proximal ends of the two legs;

at least one distal end of at least one of the legs being configured for attachment to the clamping arrangement; and the shelf of the U-shaped lower member having a lower surface thereof forming the downward facing surface of the lower member.

11. The lifting apparatus of claim 10, wherein, the upper and lower members are cooperatively configured for contacting one another to limit travel of the lower member with respect to the upper member when a load is applied to the lifting arrangement along the lifting axis.

12. The lifting apparatus of claim 11, wherein, the upper member defines an upward-facing travel limit surface thereof disposed to contact a corresponding downward-facing travel limit surface of the lower member.

13. The lifting apparatus of claim 12, wherein, the travel limit surface of the lower member includes a portion of a downward facing surface on the shelf of the lower member.

14. The lifting apparatus of claim 12, wherein:

the spring arrangement includes at least one compression spring element defining a central bore thereof extending substantially parallel to the lifting axis; and the upper and lower members each have stop elements thereof extending into lower and upper ends respectively of the central bore in the spring element, with juxtaposed surfaces of the stop elements within the central bore of the compression spring element being cooperatively configured for engaging one another to limit travel of the lower member with respect to the upper member when a load is applied to the lifting arrangement along the lifting axis.

15. The lifting apparatus of claim 14, wherein, the compression spring arrangement includes two or more spring elements disposed in a parallel force arrangement, with at least one of the springs being removable and/or replaceable to adjust the force required to move the upper and lower members with respect to one another during application of the lifting force.

16. An electrical lockout arrangement for sensing a lifting force that is to be applied via lifting device, comprising:

a first member adapted for connection to the lifting force;

a second member adapted for connection to the lifting device;

a spring arrangement disposed between the first and second members for urging the first and second members toward a non-lockout position of the lockout arrangement, the spring arrangement including a plurality of springs arranged in parallel relative to the spring force applied thereby; and a motion detection arrangement operatively connected between the first and second members for detecting relative movement of the first and second members between the non-lockout position of the electrical lockout arrangement and a lockout position of the lockout arrangement.

17. The electrical lockout arrangement of claim 16, wherein the motion detection arrangement includes a switch body mounted to the first member with a switch arm extending from the switch body.

18. The electrical lockout arrangement of claim 17, wherein the switch arm includes a distal end in contact with the second member, the switch arm configured to move based upon movement of the second member relative to the first member.

19. The electrical lockout arrangement of claim 16, wherein the motion detection arrangement includes an edge detector mounted to the second member for detecting the presence of a portion of the first member in proximity to the edge detector based upon movement of the first member relative to the second member.

20. The electrical lockout arrangement of claim 16, wherein the spring arrangement includes compression springs each defining a central bore.

21. The electrical lockout arrangement of claim 20, wherein portion of the first member and the portion of the second member are arranged in an opposed spaced relation to limit the relative motion between the first and second members.

22. The electrical lockout arrangement of claim 20, wherein the compression springs are retained between at least one first spring retaining block mounted to the first member, and at least one second spring retaining block mounted to the second member.

* * * * *

UNITED STATES PATENT AND TRADEMARK OFFICE

CERTIFICATE OF CORRECTION

PATENT NO. : 8,870,253 B2
APPLICATION NO. : 13/726727
DATED : October 28, 2014
INVENTOR(S) : Dan Eugene Mongan et al.

It is certified that error appears in the above-identified patent and that said Letters Patent is hereby corrected as shown below:

In the Claims

Column 7, line 9, claim 1, after the word "lifting" insert the word --a--

Column 8, line 49, claim 9, after the word "arrangement" insert the word --is--

Signed and Sealed this
Twenty-fourth Day of March, 2015

Michelle K. Lee

Michelle K. Lee
*Director of the United States Patent and Trademark Office*